US007603987B2

(12) United States Patent
Koivunen et al.

(10) Patent No.: US 7,603,987 B2
(45) Date of Patent: Oct. 20, 2009

(54) INJECTION PUMP FOR A PISTON ENGINE

(75) Inventors: Matti Koivunen, Vaasa (FI); Matts Friis, Kvevlax (FI); Thomas Hägglund, Sundom (FI)

(73) Assignee: Wartsila Finland Oy, Vaasa (FI)

( * ) Notice: Subject to any disclaimer, the term of this patent is extended or adjusted under 35 U.S.C. 154(b) by 0 days.

(21) Appl. No.: 12/094,434

(22) PCT Filed: Nov. 1, 2006

(86) PCT No.: PCT/FI2006/050473

§ 371 (c)(1),
(2), (4) Date: May 28, 2008

(87) PCT Pub. No.: WO2007/060285

PCT Pub. Date: May 31, 2007

(65) Prior Publication Data

US 2009/0178649 A1 Jul. 16, 2009

(30) Foreign Application Priority Data

Nov. 23, 2005 (FI) ..... 20055617

(51) Int. Cl.
*F02M 37/04* (2006.01)
*F04B 49/00* (2006.01)

(52) U.S. Cl. ..... 123/495; 417/298

(58) Field of Classification Search ..... 123/445, 123/495; 417/493, 494, 495, 499, 295, 298
See application file for complete search history.

(56) References Cited

U.S. PATENT DOCUMENTS 3,628,892 A * 12/1971 Eheim ..... 417/292
3,740,172 A * 6/1973 Ulbing ..... 417/469
3,818,882 A * 6/1974 Leonov et al. ..... 123/447
3,930,480 A 1/1976 Yamada et al.
4,180,039 A * 12/1979 Noguchi et al. ..... 123/449
5,015,160 A 5/1991 Hlousek et al.
5,056,469 A * 10/1991 Kimberley ..... 123/23
5,404,855 A * 4/1995 Yen et al. ..... 123/446
6,360,722 B1 3/2002 Onishi
6,655,927 B2 * 12/2003 Herrmann et al. ..... 417/273
7,415,973 B2 * 8/2008 Yoshizumi et al. ..... 123/495

FOREIGN PATENT DOCUMENTS

| | | |
|---|---|---|
| EP | 0678166 | 10/1995 |
| EP | 0816672 | 1/1998 |
| EP | 0971122 | 1/2000 |
| WO | 9427039 | 11/1994 |

* cited by examiner

*Primary Examiner*—Thomas N Moulis
(74) *Attorney, Agent, or Firm*—Smith-Hill & Bedell, P.C.

(57) ABSTRACT

A fuel injection pump for a piston engine, the pump comprising a cylinder element having a pressure plenum provided with an outlet chamber for removing pressurized fuel from the pressure plenum, a piston arranged to reciprocate inside the pressure plenum, an inlet chamber arranged outside the pressure plenum and at least one inlet channel arranged between the pressure plenum and the inlet chamber. At least one fill channel provided with a non-return valve is arranged between the pressure plenum and the inlet chamber, the valve allowing fuel flow from the inlet chamber to the pressure plenum but preventing flow from the pressure plenum to the inlet chamber.

11 Claims, 4 Drawing Sheets

B-B

INJECTION PUMP FOR A PISTON ENGINE

This is a national stage application filed under 35 USC 371 based on International Application No. PCT/FI2006/050473 filed Nov. 1, 2006, and claims priority under 35 USC 119 of Finnish Patent Application No. 20055617 filed Nov. 23, 2005.

The present invention relates to a fuel injection pump of a piston engine.

Injection pumps are used in piston engines for periodically introducing pressurized fuel into an injector nozzle and through the injection nozzle further into the cylinder of the engine. The injection pump comprises a cylinder element having a reciprocating piston arranged in a pressure plenum, the movement of the piston causing the increase of the pressure of the fuel. The cylinder element usually includes one or two inlet channels through which fuel is introduced into a pressure plenum from an inlet space outside it as the piston is in its bottom dead center. The piston moving upwards in the pressure plenum covers the fuel inlet channels and pressurized fuel flows from the pressure plenum to the pressure tube leading to the injector nozzle. The fuel flow to the injector nozzle is ended as a screw-like cut in the piston meets the inlet channel and opens the inlet channel.

Because the inlet channels are closed when the piston moves downwards in the pressure plenum, a vacuum is formed into the pressure plenum, the vacuum being released into the low pressure side of the fuel system as the piston reaches its bottom dead center and the inlet channels are opened. The vacuum pulse affects the operation of the fuel system and can even cause cavitation damaging the components of the system.

The aim of the invention is to provide a solution by means of which the operation of the fuel injection pump of a piston engine can be improved.

A fuel injection pump according to the invention comprises a cylinder element having a pressure plenum. The pressure plenum is provided with a reciprocating piston and an outlet channel through which pressurized fuel can be removed from the pressure plenum. An inlet chamber is arranged outside the pressure plenum, the inlet chamber being connected to the pressure plenum by means of at least one inlet channel. Additionally, at least one fill channel is arranged between the pressure plenum and the inlet chamber, the fill channel being provided with a non-return valve allowing fuel flow from the inlet chamber to the pressure plenum but preventing the flow from the pressure plenum to the inlet chamber.

Considerable advantages are achieved by means of the invention.

The non-return valve located in the fill channel opens due to the pressure difference of the inlet chamber and the pressure plenum as the piston moves downwards in the pressure plenum, i.e. it is pushed out of the pressure plenum. Thus, the piston moving downwards in the pressure plenum does not form vacuum in the pressure plenum or the vacuum is very small. Due to this, the strength of the vacuum pulses transferred into the low pressure side of the fuel system is reduced as the piston reaches its bottom dead center and the inlet channels are opened. Fuel flows through the fill channel into the pressure plenum when the non-return valve is open, whereby the pressure plenum also fills with fuel slower than previously, which also reduces the pressure pulses impinging on the low pressure side of the fuel system.

A ball located in a space in the non-return valve is used as the shut-off means of the valve in one embodiment of the invention. The ball is freely movable between its two limit positions due to the pressure difference in the inlet chamber and the pressure plenum. The ball is made of a material of low density, typically 5 kg/dm$^3$ at the most. Thus, the ball moves quickly and the valve opens and closes fast under the influence of the pressure difference.

In another embodiment of the invention the reciprocating movement of the piston is produced by means of a camshaft, the cam of which is operationally connected with the piston. When the camshaft is rotated, the piston reciprocates in the pressure plenum. The profile of the cam driving the piston is such that the return movement of the piston from the top dead center to the bottom dead center is slow enough. Thus, there is sufficiently time for the pressure plenum to fill, and the fuel flow to the pressure plenum does not cause vacuum pulses into the low pressure side. In this embodiment the rotation angle of the cam between the top dead center of the cam and the starting point of the subsequent bottom dead center is at least 100°. In other words, the cam must rotate through at least 100° for the piston to return from the top dead center back to the bottom dead center. Here, the top dead center of the cam means a point on the circumference of the cam corresponding to the top dead center of the piston. Correspondingly, the bottom dead center of the cam means a point on the circumference of the cam corresponding to the bottom dead center of the piston.

In the following, the invention is described in more detail by means of an example according to the appended drawings.

Figure 1:
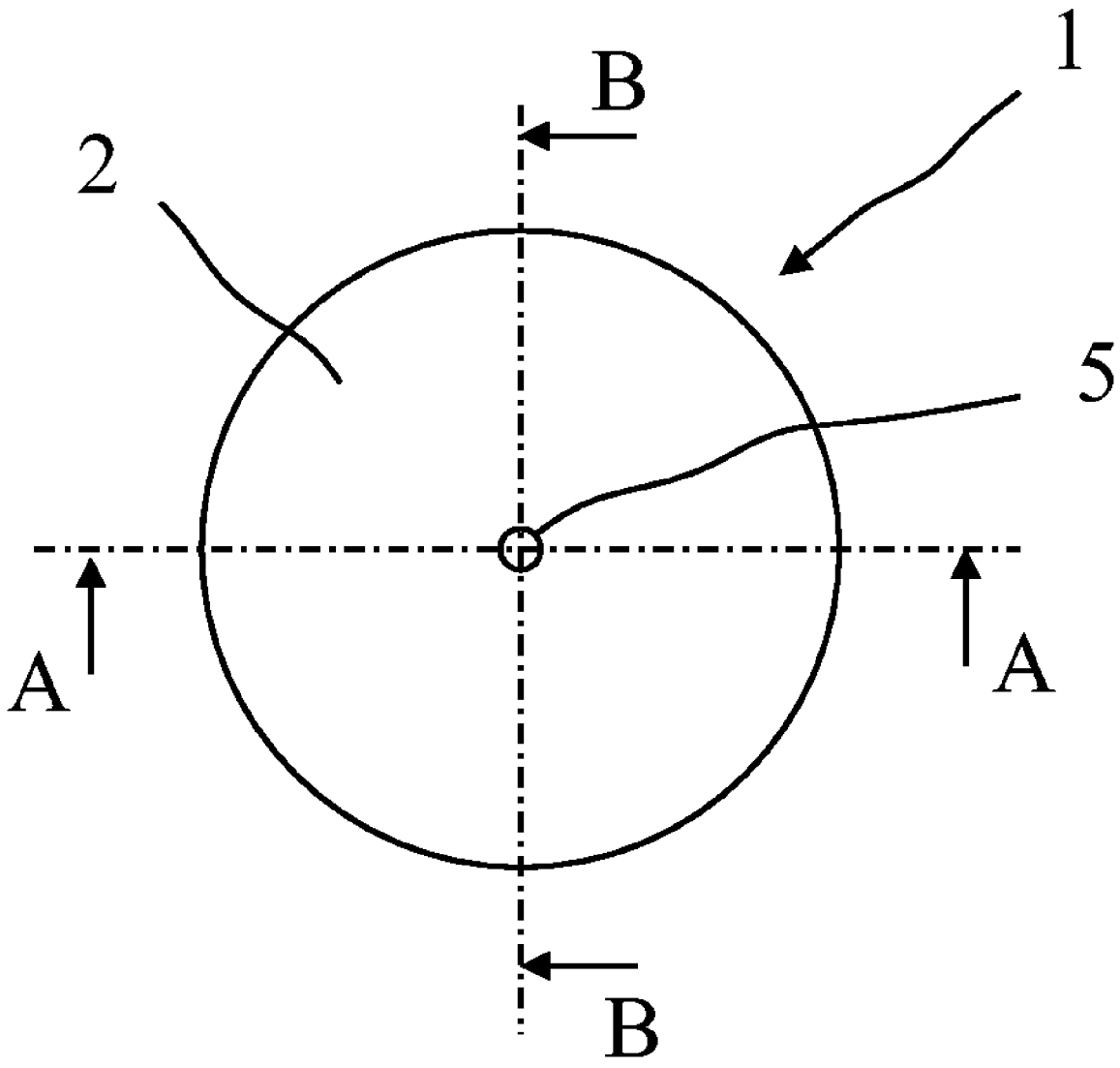
FIG. 1 illustrates an injection pump according to the invention in plan view.
Figure 2:
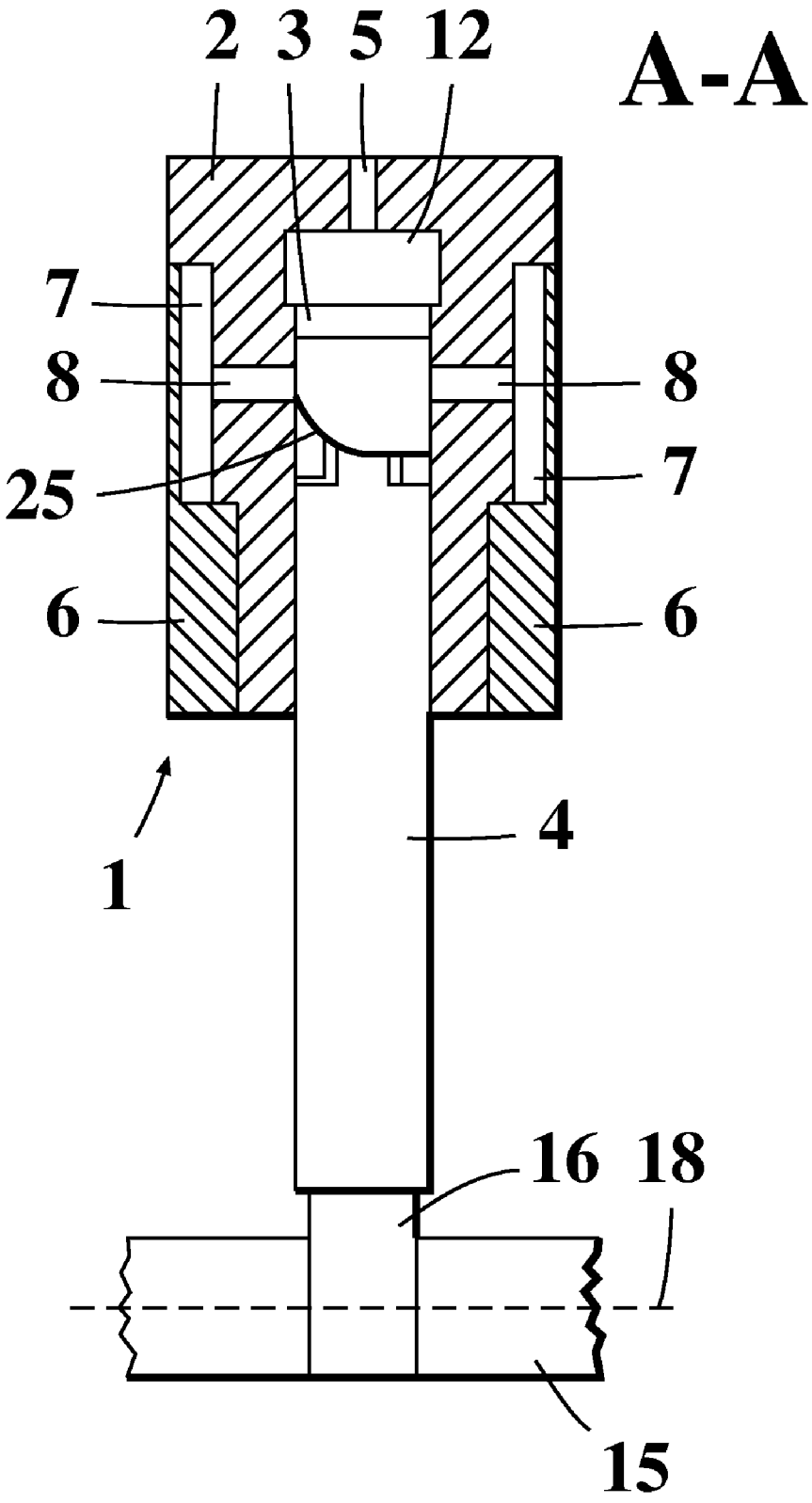
FIG. 2 is a partial section A-A of the injection pump.
Figure 3:
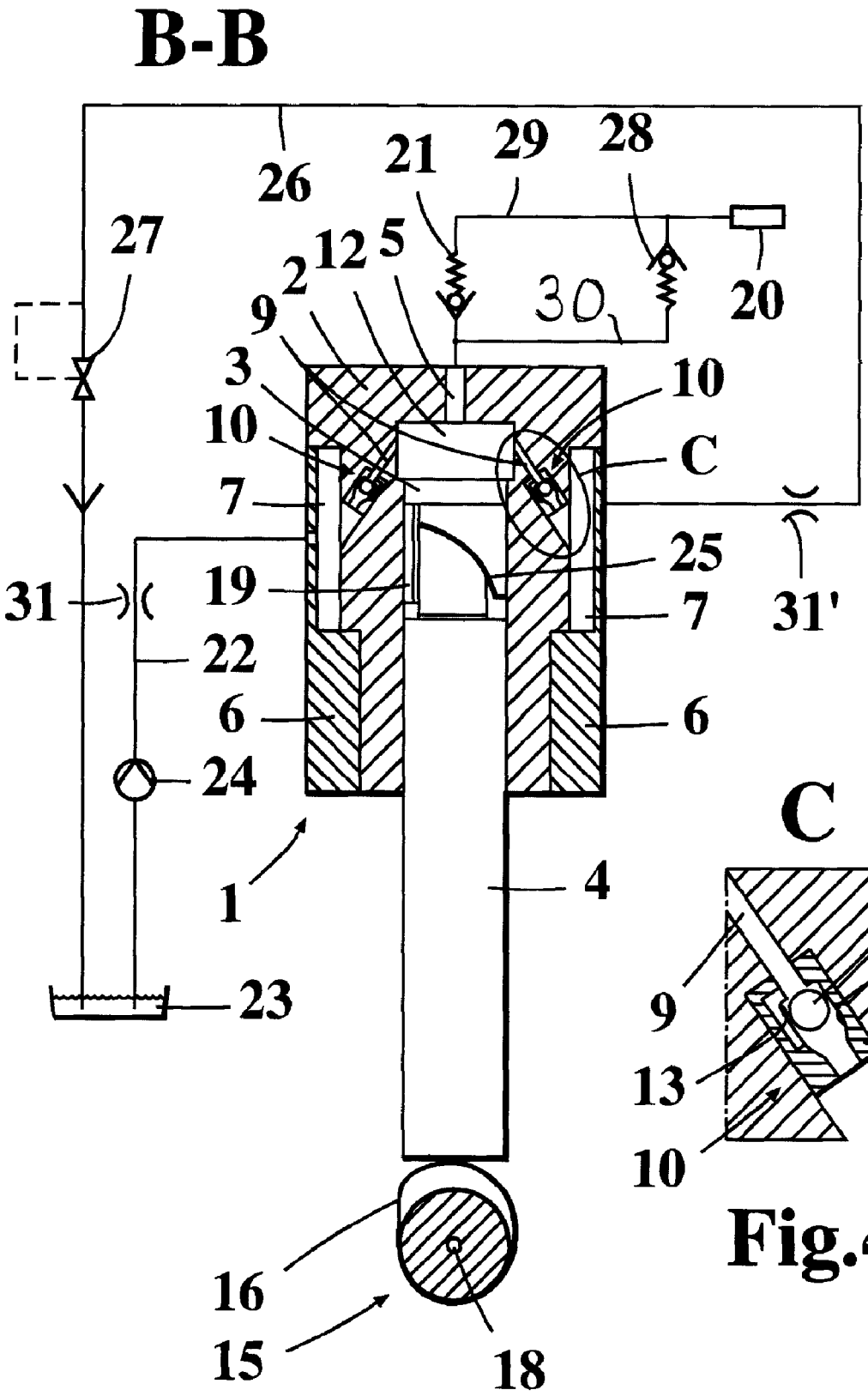
FIG. 3 is a partial section B-B of the injection pump.

The fuel injection pump 1 shown in the figures is used for pressurizing the fuel and for injecting the fuel at the desired time into the cylinder of the engine. The injection pump 1 comprises a cylinder element 2, into which a cylindrical pressure plenum 3 is formed. A reciprocating piston 4 is arranged inside the pressure plenum 3. The piston is illustrated without being sectioned in FIGS. 2 and 3. The movement of the piston 4 causes the pressurization of the fuel in the pressure plenum 3. The reciprocating movement of the piston 4 is caused by means of a cam 16 of a rotating camshaft 15, with which the piston 4 is in operational connection. The piston 4 is pressed against the cam 16 by means of a spring (not shown). A circular end groove 12 is located in the upper part of the pressure plenum 3. The diameter of the groove is larger than that in other points of the pressure plenum 3. The cylinder element 2 additionally comprises one or more outlet channels 5 opening into the pressure plenum 3, through which channel pressurized fuel is introduced into the high-pressure side of the fuel system, such as the engine cylinder injector nozzle 20. The feed channel 29 leading from the outlet channel 5 into the injector nozzle 20 is provided with a main flow valve 21 opening as the pressure in the pressure plenum 3 exceeds a certain limit value and closes as the pressure in the pressure plenum 3 decreases below this limit value. Main flow valve 21 is of the non-return valve type, i.e. it allows flow from the pressure plenum 3 to the injector nozzle 20, but prevents flow from the injector nozzle to 20 to the pressure plenum 3. The injection pump comprises a return channel 30 provided with a constant pressure valve 28, the first end of which is connected to the feed channel 29 at point between the main flow valve 21 and the injector nozzle 20. The second end of the return channel 30 is connected to the feed channel 29 at a point between the outlet channel 5 and the main flow valve 21. The constant pressure valve 28 opens when the pressure in the first end of the return channel exceeds a certain limit value and closes when the pressure drops below this limit value. The constant pressure valve 28 is also of the non-return valve type, i.e. it allows flow through the return channel 30 from the first end to the second end but prevents flow in the opposite direction. The constant pressure valve 28 is used for maintaining the pressure in feed channel 29 at a desired limit value when the injection by the injector pump 20 ends.

A longitudinal groove 19 is arranged at the side of the piston 4, parallel with the longitudinal axis of the piston. The piston 4 also comprises a screw-like cutting, i.e. the control edge 25 at the side thereof. The injector pump 1 comprises an actuator (not shown) by means of which the piston 4 can be rotated around its longitudinal axis and thus the duration of the fuel injection can be adjusted. The actuator comprises, for example, a toothed wheel arranged around the piston rod and toothed bar arranged in connection therewith, a longitudinal movement thereof causing the piston 4 to rotate around its longitudinal axis.

A sleeve-like body part 6 is arranged around the cylinder element 2. An annular inlet chamber 7 is arranged between the body part 6 and the cylinder element 2. The inlet chamber is connected to a fuel source, such as a fuel tank 23, through a fuel channel 22. The fuel channel 22 is provided with a pump 24 for pumping fuel from the fuel source to the inlet chamber 7. The inlet chamber 7 is in flow connection with the pressure plenum 3 by at least one inlet channel 8. In an embodiment shown in the drawings there are two inlet channels 8 and the inlet channels 8 are located at an angle of 180 degrees in relation to each other so that they open to the opposite sides of the inlet chamber 7.

A return channel 26 leads back to the fuel source from the inlet chamber 7. The return channel 26 is provided with a pressure regulation valve 27 by means of which the fuel pressure is adjusted to its desired maximum value. The inlet channel 22 additionally comprises a throttle 31 and the return channel 26 comprises a throttle 31' by means of which the flow in the channels 22, 26 is throttled.

The injection pump 1 comprises at least one fill channel 9 forming a flow connection between the inlet chamber 7 and pressure plenum 3. In an embodiment according to the drawings there are two fill channels 9. The openings of the fill channels 9 in the inlet chamber 7 are as far as possible from the openings of the inlet channels 8 so that the flows in the channels do not interfere with the operation of the injection pump 1. In the embodiment according to the drawings the fill channels 9 are at an angle of 180 degrees in relation to each other, i.e. they open to the opposite sides of the inlet chamber 7. The fill channels 9 are at an angle of 90 degrees in relation to the inlet channels 8. The openings of the fill channels 9 in the inlet chamber 7 are at an angle of 90 degrees in relation to the openings of the inlet channels 8. There can be more than two fill channels 9, for example four. However, preferably the amount of fill channels is an even number. In the pressure plenum 3 the fill channels 9 open into the end groove 12.

Figure 4:
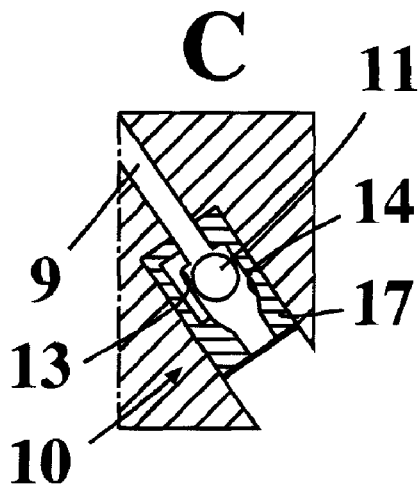
FIG. 4 is a partial enlargement C of FIG. 3.

Each fill channel 9 is provided with a non-return valve 10, i.e. a valve through which fuel can flow in one direction only. The construction of the valve 10 is illustrated in closer detail in FIG. 4. The valve 10 comprises a body 17 inside which is a space including a shut-off means 11, such as a ball. The shut-off means 11 can freely move between the first and second limit positions due to the pressure difference between the pressure plenum 3 and the inlet chamber 7. In the first limit position the shut-off means 11 is against the sealing surface 14 and prevents fuel flow from the pressure plenum 3 through the valve 10 into the inlet chamber 7. The shut-off means 11 is in the first limit position when the pressure in the pressure plenum 3 is higher than in the inlet chamber 7. In the second limit position the shut-off means 11 is against the support surface 13, whereby fuel is allowed to flow from the inlet chamber 7 through the valve 10 into the pressure plenum 3. The shut-off means 11 is in the second limit position when the pressure in the inlet chamber 7 is higher than that in the pressure plenum 3. The travel of the shut-off means 11 between the limit positions is relatively short, about 1 mm, so that the valve can open and close quickly. In the injection pumps used in large diesel engines the diameter of the ball used as the shut-off means is 3-7 mm.

The ball or other shut-off means is made of a ceramic material or other material suitable for the application, the material having a suitably low density. Due to the low density the shut-off means 11 moves quickly between the limit positions under the influence of pressure difference between the inlet channel 7 and the pressure plenum 3. The ceramic material can be, for example, silicon nitride ($Si_3N_4$). The density of a shut-off means 11 made of silicon nitride is 2.8-. 3.5 kg/dm$^3$ depending on the alloying and the production method. Typically the density of a shut-off means 11 is less than 5 kg/dm$^3$, preferably less than 4 kg/dm$^3$. However, the density of the shut-off means 11 is at least 3 kg/dm$^3$.

Figure 5:
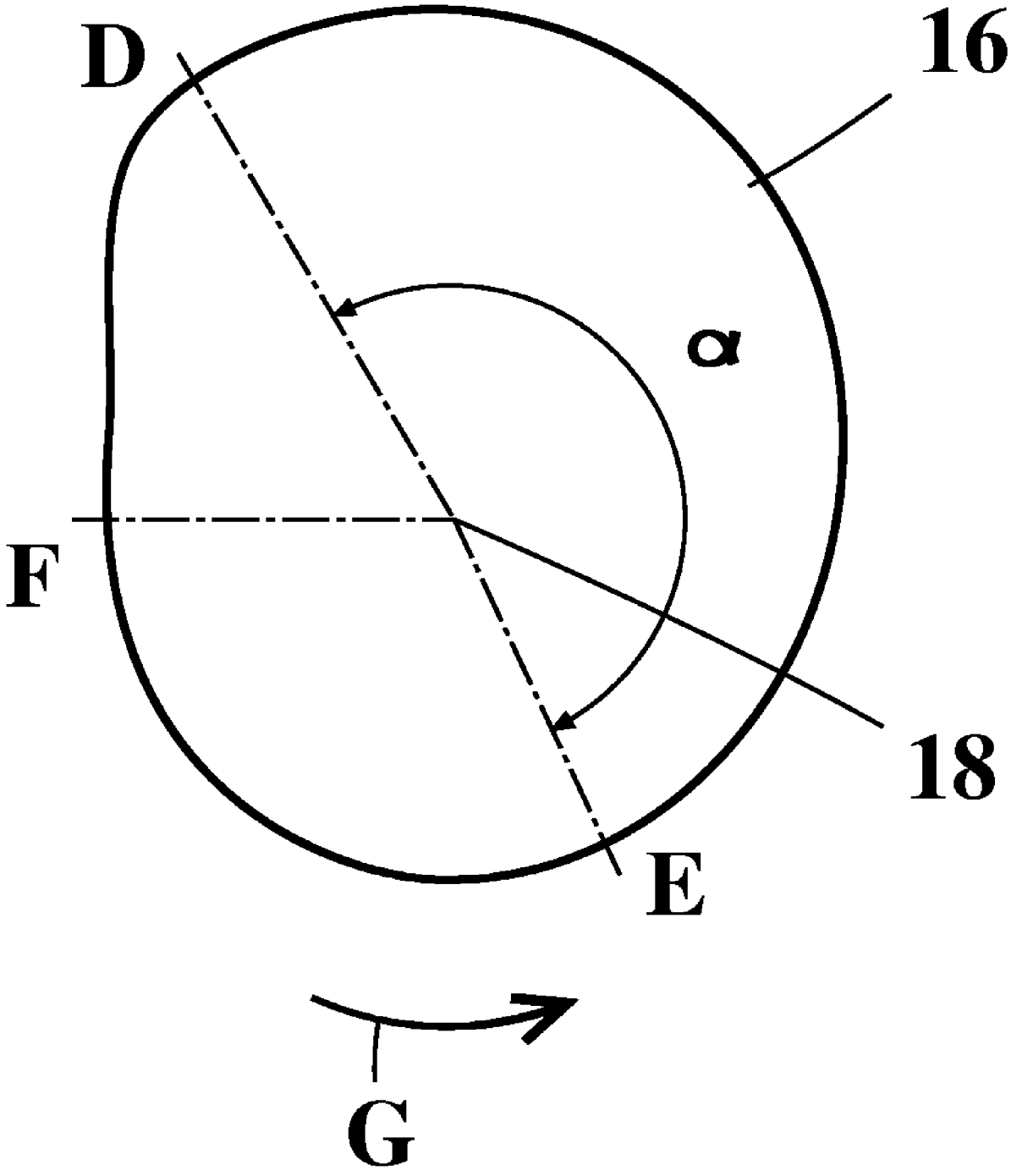
FIG. 5 illustrates the profile of the camshaft driving the piston of the injection pump of FIG. 1.

The reciprocating movement of the piston 4 is produced by means of a cam 16 of a rotating camshaft 15. The lower end of the piston 4 lies against the circumference of the cam 16 of the camshaft 15. The piston 4 is additionally in operational connection with a spring pressing the piston 4 against the cam 16 during the return movement. The profile of the cam 16 cooperating with the piston 4 is such that the piston 4 returns slowly enough from its top dead center back to its bottom dead center. Thus there is enough time for the pressure plenum 3 to fill with fuel and the flow of fuel into the pressure plenum 3 does not cause large vacuum pulses to the low-pressure side of the fuel system. One such cam profile is described in more detail on FIG. 5. The rotation direction of the cam 16 is marked by arrow G. The cam 16 rotates around the axis 18. The point corresponding to the top dead center of the piston 4 on the circumference of the cam 16 is marked by letter D. In this point the distance from the circumference 16 to the rotation axis 18 is at its largest. The letter E denotes a point on the circumference of the cam 16 in which the piston 4 reaches the bottom dead center the next time after the top dead center D as the cam 16 rotates. In this point the distance between the circumference of the cam 16 and the axis of rotation 18 is at its smallest. In a cam 16 used in the invention the angle of rotation a between the points D and E is preferably at least 100°, preferably at least 160° The angle of rotation $\alpha$ is at most 240°, preferably at most 200°. Typically the angle of rotation $\alpha$ is about 180°. The cam 16 must therefore be rotated by the angle of rotation $\alpha$ for the piston 4 to return from its top dead center to its bottom dead center.

The operation of the injection pump 1 is described in more detail in the following. The camshaft 15 and the cam 16 rotate around the axis 18. When the piston 4 is in the bottom dead center (i.e. the lower part of the piston 4 is between points E-F on the circumference of the cam 16) fuel flows from the inlet chamber 7 through inlet channels 8 and fill channels 9 to the pressure plenum 3. When the piston 4 starts its upward movement from the bottom dead center (the point F at the circumference of the cam), the non-return valve 10 closes and the fuel flow through the fill channels 9 to the pressure plenum 3 ends. The piston 4, moving upwards, covers the inlet channels 8, whereby the fuel flow from the inlet chamber 7 through the inlet channels 8 to the pressure plenum 3 ends. The piston 4 moving upwards in the pressure plenum 3 pressurizes the fuel in pressure plenum 3 and the fuel flows through the outlet channel 5 and the main flow valve 21 out from the pressure plenum 3. The fuel flow through outlet channel 5 continues until the control edge 25 of the piston 4 meets the openings of the inlet channels 8 and uncovers the openings. Then, the pressure of the fuel in the pressure plenum 3 is released via the longitudinal groove 19 of the piston 4 and the inlet channels 8 into the inlet chamber 7. If the piston 4 is rotated about its longitudinal axis, the control edge 25 will meet the openings of the inlet channels 8 earlier or later depending on the direction of the rotation, whereby the fuel feed into the outlet channel 5 ends earlier or later. Thus, rotation of the piston 4 adjusts the duration of the injection into the outlet channel 5.

The piston 4 reaches its top dead center D and then starts to move downwards in the pressure plenum 3 (the bottom part of the piston between the points D-E on the circumference of the cam 16). The piston 4 again covers the openings of the inlet channels 8 and the downwards moving piston 4 forms a vacuum in the pressure plenum 3. When the pressure in the pressure plenum 3 is lower than in the inlet chamber 7, the valves 10 open and fuel flows through the fill openings 9 into the pressure plenum 3. Near the bottom dead center E the piston 4 uncovers the openings of the inlet channels 8 and fuel flows to the pressure plenum 3 through the inlet channels as well. The piston 4 reaches the starting point E of the bottom dead center and stays in the bottom dead center for a while (the bottom part of the piston between the points E-F on the circumference of the cam 16), whereby fuel flows into the pressure plenum 3 through inlet channels 8 and fill channels 9. The piston 4 moves from the top dead center to the bottom dead center slower than from the bottom dead center to the top dead center.

The invention claimed is:

1. A fuel injection pump for a piston engine, the pump comprising:

a cylinder element having a pressure plenum provided with an outlet channel for removing pressurized fuel from the pressure plenum, a piston arranged to reciprocate in the pressure plenum, an inlet chamber arranged outside the pressure plenum, and at least one inlet channel arranged between the pressure plenum and the inlet chamber, wherein at least one fill channel provided with a non-return valve is arranged between the pressure plenum and the inlet chamber, the non-return valve allowing fuel flow from the inlet chamber to the pressure plenum but preventing flow from the pressure plenum to the inlet chamber.

2. An injection pump according to claim 1, wherein the non-return valve comprises a body), inside which a shut-off means is arranged so as to move freely between two limit positions.

3. An injection pump according to claim 2, wherein the shut-off means is made of a ceramic material, such as silicon nitride ($Si_3N_4$).

4. An injection pump according to claim 2, wherein the density of the shut-off means is 5 kg/dm3 at the most.

5. An injection pump according to claim 1, wherein a body part is arranged around the cylinder element and that there is an annular inlet chamber between the cylinder element and the body part.

6. An injection pump according to claim 5, wherein the number of inlet channels is two and that they open into the opposite sides of the inlet chamber.

7. An injection pump according to claim 5, wherein the number of fill channels is two and that they open into the opposite sides of the inlet chamber.

8. An injection pump according to claim 6, wherein the inlet channels and the fill channels are at an angle of 90 degrees in relation to each other.

9. An injection pump according to claim 1, wherein the reciprocating movement of the piston is produced by means of a cam of a rotatably arranged camshaft, the angle of rotation of the cam between the top dead center and the subsequent bottom dead center being at least 100°.

10. An injection pump according to claim 9, wherein the angle of rotation between the top dead center and the subsequent bottom dead center is at most 240°.

11. A fuel injection pump for a piston engine, the pump comprising:

a cylinder member defining a pressure plenum, an outlet chamber for removing pressurized fuel from the pressure plenum, an inlet chamber outside the pressure plenum, at least one inlet channel providing communication between the inlet chamber and the pressure plenum, and at least one fill channel for supplying fuel from the inlet chamber to the pressure plenum, and a piston fitted in the pressure plenum to reciprocate therein, and wherein each fill channel is provided with a non-return valve that allows fuel flow from the inlet chamber to the pressure plenum but prevents flow from the pressure plenum to the inlet chamber.

* * * * *